US006654473B2

(12) United States Patent
Collins

(10) Patent No.: US 6,654,473 B2
(45) Date of Patent: Nov. 25, 2003

(54) CONDENSER MICROPHONE

(75) Inventor: James Steven Collins, Elk Grove Village, IL (US)

(73) Assignee: Knowles Electronics, LLC, Itasca, IL (US)

( * ) Notice: Subject to any disclaimer, the term of this patent is extended or adjusted under 35 U.S.C. 154(b) by 378 days.

(21) Appl. No.: 09/851,907

(22) Filed: May 9, 2001

(65) Prior Publication Data

US 2002/0168076 A1 Nov. 14, 2002

(51) Int. Cl.[7] ..... H04R 9/08
(52) U.S. Cl. ..... 381/355; 381/369
(58) Field of Search ..... 381/355, 356, 381/361, 369, 170, 171, 173, 174, 175, 177

(56) References Cited

U.S. PATENT DOCUMENTS 4,170,721 A * 10/1979 Ishibashi et al. ..... 381/355
4,281,222 A * 7/1981 Nakagawa et al. ..... 381/369
4,302,633 A * 11/1981 Tamamura et al. ..... 381/355
4,456,796 A * 6/1984 Nakagawa et al. ..... 381/355
4,516,428 A * 5/1985 Konomi ..... 381/356
5,097,515 A * 3/1992 Baba ..... 381/355
5,570,428 A * 10/1996 Madaffari et al. ..... 381/355
6,366,678 B1 * 4/2002 Madaffari et al. ..... 381/324
6,383,832 B1 * 5/2002 Nakabayashi ..... 438/50

* cited by examiner

*Primary Examiner*—Rexford Barnie
(74) *Attorney, Agent, or Firm*—Marshall, Gerstein & Borun LLP

(57) ABSTRACT

A condenser microphone, and method of construction, is disclosed. The microphone comprises a cup-shaped housing having a base surface and an upstanding peripheral wall. The wall terminates at a distal edge defining an opening. The microphone further comprises a diaphragm and ring assembly disposed on the base surface and having a peripheral edge, a backplate having a peripheral edge, and a spacing washer disposed between the diaphragm and ring assembly and the backplate for separating the diaphragm and ring assembly from the backplate. The microphone also comprises a substrate closing the housing opening. The spacer is disposed between the peripheral housing wall and the peripheral edges of the diaphragm and ring assembly and the backplate. The spacer includes a radially inwardly directed flange which engages an upper peripheral surface of the backplate.

16 Claims, 1 Drawing Sheet

CONDENSER MICROPHONE

CROSS-REFERENCE TO RELATED APPLICATIONS

Not applicable.

FEDERALLY SPONSORED RESEARCH OR DEVELOPMENT

Not applicable.

TECHNICAL FIELD

The present invention relates to a condenser microphone.

BACKGROUND OF THE INVENTION

Electret condenser microphones (ECM's) typically include a diaphragm and ring assembly, a backplate, and a spacing washer separating the diaphragm and ring assembly from the backplate. They also typically include an FET mounted on a PC (printed circuit) board. ECM's of the lower-end variety, are made in generally the same way and have two major drawbacks.

In these lower-end ECM's, the parts are dropped into an aluminum housing, or can. Because of part tolerance problems, the parts may not be properly centered within the can, and this results in the active portion of the moving diaphragm being touched by elements that are not supposed to touch it, thus adversely effecting performance and production yield.

The main problem, however, is that the top of such ECM cans are rolled closed at the upper edge. The forces used to roll the microphone closed and sealed can be very large, and this force is transmitted though all the internal parts. All ECM's use the product TEFLON "FEP" somewhere in their design to hold the electrostatic charge. Sometimes it is used as the moving diaphragm and sometimes it is used to coat the backplate. But TEFLON is soft, and under the rolling/sealing force, it becomes distorted and changes its thickness. As the thickness changes, the performance and yield of the microphone changes due to changes in the critical space between the moving diaphragm and the backplate.

SUMMARY OF THE INVENTION

It is an object of the invention to provide a condenser microphone.

In accordance with this aspect of the invention, the microphone comprises a cup-shaped housing having a base surface and an upstanding peripheral wall. The wall terminates at a distal edge defining an opening. The microphone further includes a diaphragm and ring assembly disposed on the base surface and having a peripheral edge, a backplate having a peripheral edge, and a means disposed between the diaphragm and ring assembly and the backplate for separating the diaphragm and ring assembly from the backplate. A substrate closes the housing opening, and a spacer is disposed between the peripheral housing wall and the peripheral edges of the diaphragm and ring assembly and the backplate. The spacer has an upper edge engaging the printed circuit board and a radially inwardly directed flange engaging an upper peripheral surface of the backplate.

It is contemplated that the spacer is plastic.

It is further contemplated that the separating means is a spacing washer.

It is still further contemplated that the substrate is a printed circuit board.

It is a further object of the invention to provide a method of constructing an electret condenser microphone.

In accordance with this aspect of the invention, the method comprises providing a cup-shaped housing having a base surface and an upstanding peripheral wall. The wall terminates at a distal edge defining an opening. The method further comprises inserting a diaphragm and ring assembly on the base surface. The diaphragm and ring assembly has a peripheral edge. The method still further comprises placing a spacing washer on the peripheral edge of the diaphragm and ring assembly, placing a backplate on the spacing washer, the backplate having a peripheral edge, and placing a spacer between the peripheral housing wall and the peripheral edges of the diaphragm and ring assembly and the backplate, the spacer having an upper surface. The method further comprises placing a substrate across the housing opening and on the spacer upper surface, and rolling the housing distal edge into engagement with the substrate to seal the microphone. The spacer transfers the rolling force from the substrate to the housing base surface.

It is contemplated that the spacer includes a radially inward directed flange engaging an upper peripheral surface of the backplate to transfer the rolling force to the housing base surface via the peripheral edge of the backplate, the spacing washer and the ring.

It is further contemplated that the spacer is plastic.

It is still further contemplated that the substrate is a printed circuit board.

DETAILED DESCRIPTION OF THE PREFERRED EMBODIMENT

Figure 1:
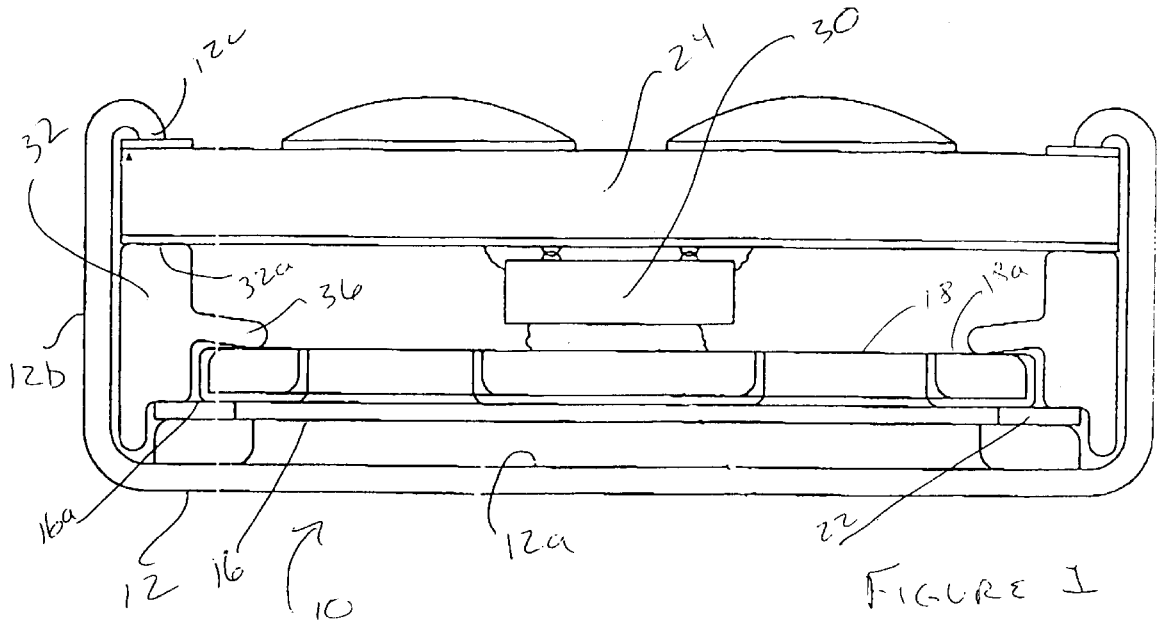
FIG. 1 is a sectional view of a sealed electret condenser microphone in accordance with the invention.

While this invention is susceptible of embodiment in many different forms, there is shown in the drawings and will herein be described in detail, a preferred embodiment of the invention with the understanding that the present disclosure is to be considered as an exemplification of the principles of the invention and is not intended to limit the broad aspect of the invention to the embodiment illustrated.

Figure 2:
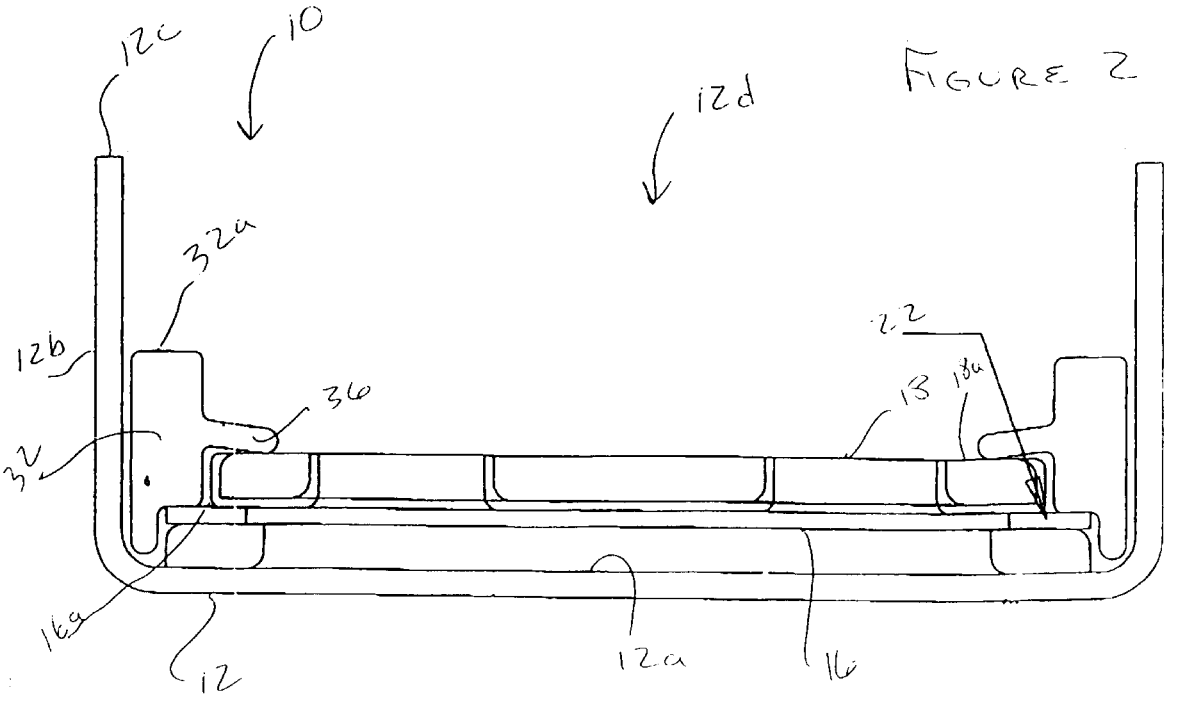
FIG. 2 is a sectional view of an unsealed electret condenser microphone in accordance with the invention.

A condenser microphone 10 according to the invention is illustrated in FIGS. 1 and 2. The microphone 10 includes a cup-shaped housing 12 having a base surface 12*a* and an upstanding peripheral wall 12*b*. The wall 12*b* terminates at a distal edge 12*c* defining an opening 12*d*. The microphone 10 further includes a diaphragm and ring assembly 16 disposed on the base surface 12*a* and having a peripheral edge 16*a*, and a backplate 18 having a peripheral edge 18*a*. The microphone 10 still further includes a spacing washer 22 disposed between the diaphragm and ring assembly 16 and the backplate 18 for separating the diaphragm and ring assembly 16 from the backplate 18. A printed circuit board 24 carrying electronic components, such as an FET 30, closes the housing opening 12*d* by rolling down the distal edge 12*c* of the peripheral wall 12*b*, as shown in FIG. 1. A plastic spacer 32 is disposed between the peripheral housing wall 12*b* and the peripheral edges of the diaphragm and ring assembly 16 and the backplate 18. The plastic spacer keeps the diaphragm and ring assembly 16 and the backplate 18 properly positioned in the housing 12. The spacer 32 also has an upper edge 32*a* engaging the printed circuit board 24 and a radially inwardly directed flange 36 engaging an upper peripheral surface of the backplate 18.

The method of construction the microphone 10 is as follows.

The diaphragm and ring assembly 16 is placed on the base surface 12*a*, and the spacing washer 22 is placed on the peripheral edge 16*a* of the diaphragm and ring assembly 16. The backplate 18 is then placed on the spacing washer 22. The plastic spacer 32 is placed between the peripheral housing wall 12*b* and the peripheral edges of the diaphragm and ring assembly 16 and the backplate 18, such that the flange 36 engages the upper peripheral surface of the backplate 18. The printed circuit board 24 is placed across the housing opening 12*d* and on the spacer upper surface 32*a*. The housing distal edge 12*c* is rolled into engagement with the printed circuit board 24 to seal the microphone 10. This rolling creates a downward rolling force. The spacer 32 transfers the rolling force from the printed circuit board 24 to the housing base surface 12*a* via the peripheral edge of the backplate 18, the spacing washer 22 and the ring of the ring and diaphragm assembly 16, which are all generally robust enough not to be adversely affected. The flange 36 acts as a spring, holding the backplate 18 in position and not distorting the TEFLON on the part.

While the specific embodiment has been illustrated and described, numerous modifications come to mind without significantly departing from the spirit of the invention and the scope of protection is only limited by the scope of the accompanying claims.

I claim:

1. A condenser microphone comprising:

a cup-shaped housing having a base surface and an upstanding peripheral wall, the peripheral wall terminating at a distal edge defining an opening;

a diaphragm and ring assembly disposed on the base surface and having a peripheral edge;

a backplate having a peripheral edge;

means disposed between the diaphragm and ring assembly and the backplate for separating the diaphragm and ring assembly from the backplate;

a substrate closing the housing opening;

a spacer disposed between the peripheral housing wall and the peripheral edges of the diaphragm and ring assembly and the backplate, wherein the distal edge of the peripheral wall is rolled to sealingly engage the substrate, creating a rolling force, and the spacer includes means for transfer the rolling force from the printed circuit board to the base surface.

2. The microphone of claim 1, wherein the spacer includes a radially inwardly directed flange which engages an upper peripheral surface of the backplate.

3. The microphone of claim 1, wherein the spacer is plastic.

4. The microphone of claim 1, wherein the separating means is a spacer washer.

5. The microphone of claim 1, wherein the substrate is a printed circuit board.

6. The microphone of claim 1, wherein the spacer has an upper end engaging the substrate.

7. A condenser microphone comprising:

a cup-shaped housing having a base surface and an upstanding peripheral wall, the wall terminating at a distal edge defining an opening;

a diaphragm and ring assembly disposed on the base surface and having a peripheral edge;

a backplate having a peripheral edge;

means disposed between the diaphragm and ring assembly and the backplate for separating the diaphragm and ring assembly from the backplate;

a substrate closing the housing opening;

a spacer disposed between the peripheral housing wall and the peripheral edges of the diaphragm and ring assembly and the backplate, wherein the spacer has an upper edge engaging the printed circuit board and the spacer includes a radially inward directed flange engaging an upper peripheral surface of the backplate.

8. The microphone of claim 7, wherein the spacer is plastic.

9. The microphone of claim 7, wherein the separating means is a spacing washer.

10. The microphone of claim 7, wherein the substrate is a printed circuit board.

11. A method of constructing an electret condenser microphone comprising:

providing a cup-shaped housing having a base surface and an upstanding peripheral wall, the wall terminating at a distal edge defining an opening;

inserting a diaphragm and ring assembly on the base surface, the diaphragm and ring assembly having a peripheral edge;

placing a spacing washer on the peripheral edge of the diaphragm and ring assembly;

placing a backplate on the spacing washer, the backplate having a peripheral edge;

placing a spacer between the peripheral housing wall and the peripheral edges of the diaphragm and ring assembly and the backplate, the spacer having an upper surface;

placing a substrate across the housing opening and on the spacer upper surface; and rolling the housing distal edge into engagement with the substrate to seal the microphone, wherein the spacer transfers the rolling force from the substrate to the housing base surface.

12. The method of claim 11, wherein the spacer includes a radially inward directed flange engaging an upper peripheral surface of the backplate to transfer the rolling force to the housing base surface via the peripheral edge of the backplate, the spacing washer and the ring.

13. The method of claim 11, wherein the spacer is plastic.

14. The method of claim 11, wherein the substrate is a printed circuit board.

15. A method of constructing an electret condenser microphone comprising:

providing a cup-shaped housing having a base surface and an upstanding peripheral wall, the wall terminating at a distal edge defining an opening;

inserting a diaphragm and ring assembly on the base surface, the diaphragm and ring assembly having a peripheral edge;

placing a spacing washer on the peripheral edge of the diaphragm and ring assembly;

placing a backplate on the spacing washer, the backplate having a peripheral edge;

placing a spacer between the peripheral housing wall and the peripheral edges of the diaphragm and ring assembly and the backplate, the spacer having an upper surface and a radially inward directed flange engaging an upper peripheral surface of the backplate;

placing a printed circuit board across the housing opening and on the spacer upper surface; and rolling, the housing distal edge into engagement with the printed circuit board to seal the microphone, wherein the spacer transfers the rolling force from the printed circuit board to the housing base surface via the peripheral edge of the backplate, the spacing washer and the ring.

16. The method of claim 14, wherein the spacer is plastic.

* * * * *

UNITED STATES PATENT AND TRADEMARK OFFICE

CERTIFICATE OF CORRECTION

PATENT NO. : 6,654,473 B2
DATED : November 25, 2003
INVENTOR(S) : James Steven Collins It is certified that error appears in the above-identified patent and that said Letters Patent is hereby corrected as shown below:

Column 5,
Line 3, please delete "rolling," and insert -- rolling --.

Signed and Sealed this

Twenty-fourth Day of February, 2004

JON W. DUDAS
*Acting Director of the United States Patent and Trademark Office*